US011440759B2

(12) United States Patent
Araki et al.

(10) Patent No.: US 11,440,759 B2
(45) Date of Patent: Sep. 13, 2022

(54) SHEET TRANSPORT DEVICE AND NON-TRANSITORY COMPUTER READABLE MEDIUM

(71) Applicant: FUJIFILM Business Innovation Corp., Tokyo (JP)

(72) Inventors: Yuichi Araki, Kanagawa (JP); Masahito Niwa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/920,750

(22) Filed: Jul. 5, 2020

(65) Prior Publication Data

US 2021/0237996 A1 Aug. 5, 2021

(30) Foreign Application Priority Data

Feb. 4, 2020 (JP) ..... JP2020-017239

(51) Int. Cl.
*B65H 7/20* (2006.01)
*B65H 5/10* (2006.01)
*B65H 7/12* (2006.01)

(52) U.S. Cl.
CPC ..... *B65H 7/20* (2013.01); *B65H 5/10* (2013.01); *B65H 7/12* (2013.01); *B65H 2513/10* (2013.01); *B65H 2513/21* (2013.01); *B65H 2515/112* (2013.01); *B65H 2515/32* (2013.01); *B65H 2515/81* (2013.01)

(58) Field of Classification Search
CPC ..... B65H 3/04; B65H 3/0669; B65H 3/12; B65H 3/124; B65H 5/021; B65H 5/06; B65H 7/18; B65H 7/20; B65H 2513/10; B65H 2513/21; B65H 2515/112; B65H 2515/32; B65H 2515/81
See application file for complete search history.

(56) References Cited

U.S. PATENT DOCUMENTS

| | | | | |
|---|---|---|---|---|
| 6,398,207 | B1 | 6/2002 | Taylor et al. | |
| 9,284,139 | B2 * | 3/2016 | Otsuka | B65H 3/0833 |
| 2009/0057984 | A1 * | 3/2009 | Matsumoto | B65H 7/18 271/10.09 |
| 2011/0262152 | A1 * | 10/2011 | Koizumi | G03G 15/5029 271/265.04 |
| 2013/0026696 | A1 * | 1/2013 | Matsumoto | B65H 3/48 271/5 |
| 2018/0118491 | A1 * | 5/2018 | Wang | B65H 3/0669 |
| 2019/0071269 | A1 * | 3/2019 | Ikeshita | B65H 3/128 |

FOREIGN PATENT DOCUMENTS

JP 2002019978 1/2002

* cited by examiner

*Primary Examiner* — Prasad V Gokhale
(74) *Attorney, Agent, or Firm* — JCIPRNET

(57) ABSTRACT

A sheet transport device includes a processor configured to adjust movement of a transport unit that transports a sheet on the basis of a transport load of the sheet.

14 Claims, 14 Drawing Sheets

SHEET TRANSPORT DEVICE AND NON-TRANSITORY COMPUTER READABLE MEDIUM

CROSS-REFERENCE TO RELATED APPLICATIONS

This application is based on and claims priority under 35 USC 119 from Japanese Patent Application No. 2020-017239 filed Feb. 4, 2020.

BACKGROUND

(i) Technical Field

The present disclosure relates to a sheet transport device and a non-transitory computer readable medium.

(ii) Related Art

Japanese Unexamined Patent Application Publication No. 2002-019978 discloses a paper feeding device that feeds paper from a paper stack to a processing unit.

The paper feeding device includes a paper tray that holds the paper stack and an air plenum that is disposed above the paper stack and has a sealing mechanism around an outer periphery thereof. The paper feeding device includes an air blower that creates a vacuum pressure in the air plenum so that paper of the paper stack is sucked to make contact with the air plenum and the sealing mechanism. The air plenum has a corrugating surface for corrugating paper into a shape of plural waves, and the sealing mechanism is in conformity with the shape of plural waves of the paper.

SUMMARY

Aspects of non-limiting embodiments of the present disclosure relate to providing a sheet transport device and a non-transitory computer readable medium that can make a transfer failure less likely to occur with a low-cost structure as compared with a case where a sheet transport speed is always constant.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet transport device including a processor configured to adjust movement of a transport unit that transports a sheet on the basis of a transport load of the sheet.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
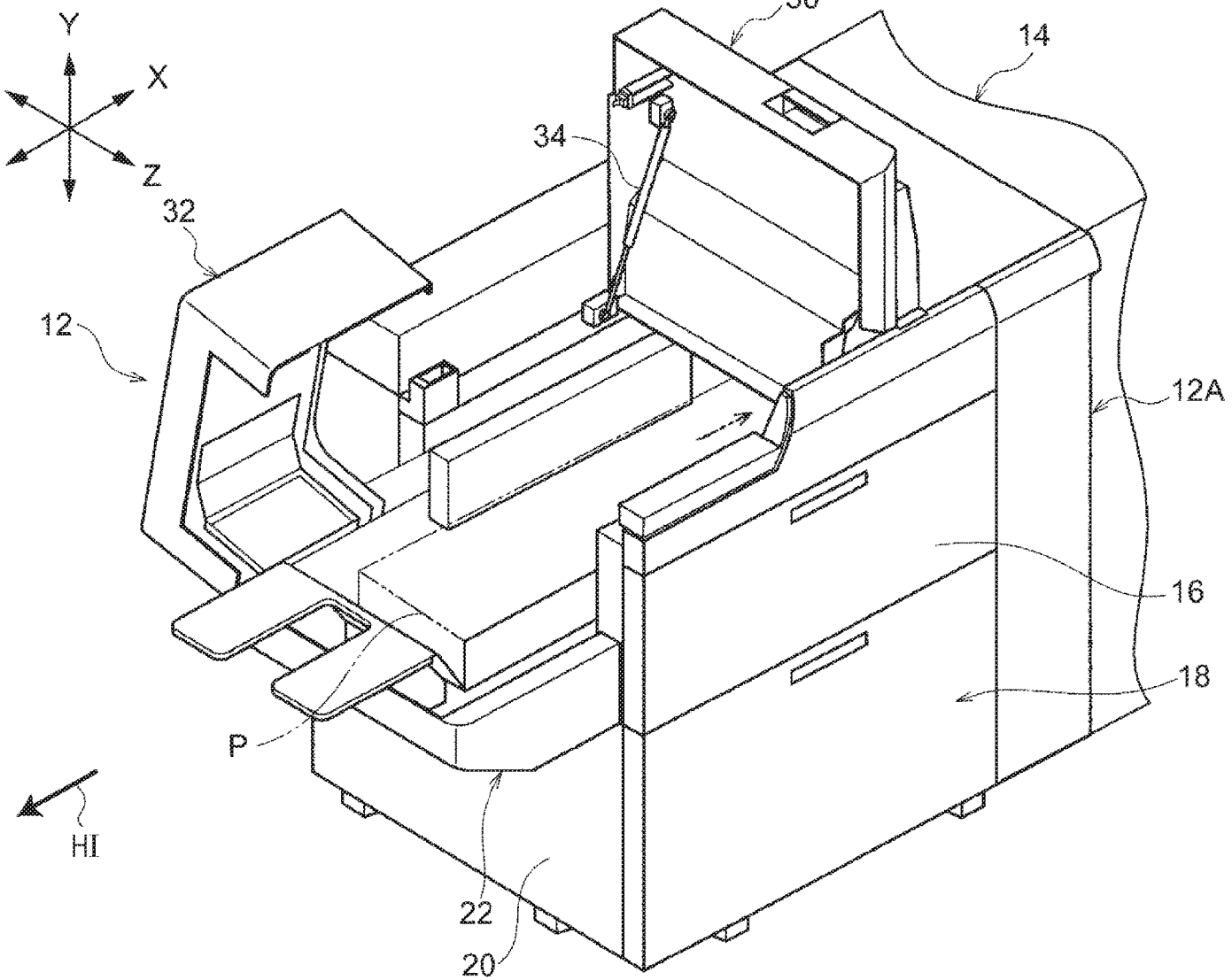
FIG. 1 is a perspective view illustrating an image forming apparatus including a sheet transport device according to a first exemplary embodiment.

A first exemplary embodiment is described below with reference to the drawings.

In the following description, a direction indicated by arrow X in the drawings is a device width direction and a direction indicated by arrow Y in the drawings is a device height direction. Furthermore, a direction indicated by arrow Z that is orthogonal to the device width direction X and the device height direction Y is a device depth direction.

FIG. 1 is a perspective view illustrating an image forming apparatus 14 provided with a sheet feeding device 12 having a sheet transport device 10 (see FIG. 3) according to the present exemplary embodiment. The image forming apparatus 14 is an apparatus that forms an image on a sheet P, and the image forming apparatus 14 includes an image forming unit (not illustrated) that forms an image on the sheet P and a transport unit (not illustrated) that transports the sheet P to the image forming unit.

A device body 12A of the sheet feeding device 12 has an upper containing unit 16 and a lower containing unit 18 for containing the sheets P. The upper containing unit 16 and the lower containing unit 18 can be drawn out from the device body 12A. Furthermore, an extended unit 22 that extends from a surface 20 on one side HI in the width direction is optionally attachable to the device body 12A. FIG. 1 illustrates a state where the extended unit 22 has been attached to the device body 12A.

The sheet P is, in other words, a medium or a film on which an image is to be formed. The sheet P is, for example, a sheet made of paper or an OHP sheet made of a PET resin. Examples of the sheet P on which an image is to be formed include a normal sheet fed from the containing unit 16 or 18 and a long sheet fed by using the extended unit 22. Plural kinds of sheets P such as sheets P having different thicknesses, sheets P having different width dimensions, and sheets P having different lengths can be used.

An upper part of the upper containing unit 16 is openable and closable by a covering part 30 supported by the device body 12A and an extension covering part 32 supported by the extended unit 22, and a damper 34 extended from the device body 12A is coupled to the covering part 30 to support the opening and closing operation.

Figure 2:
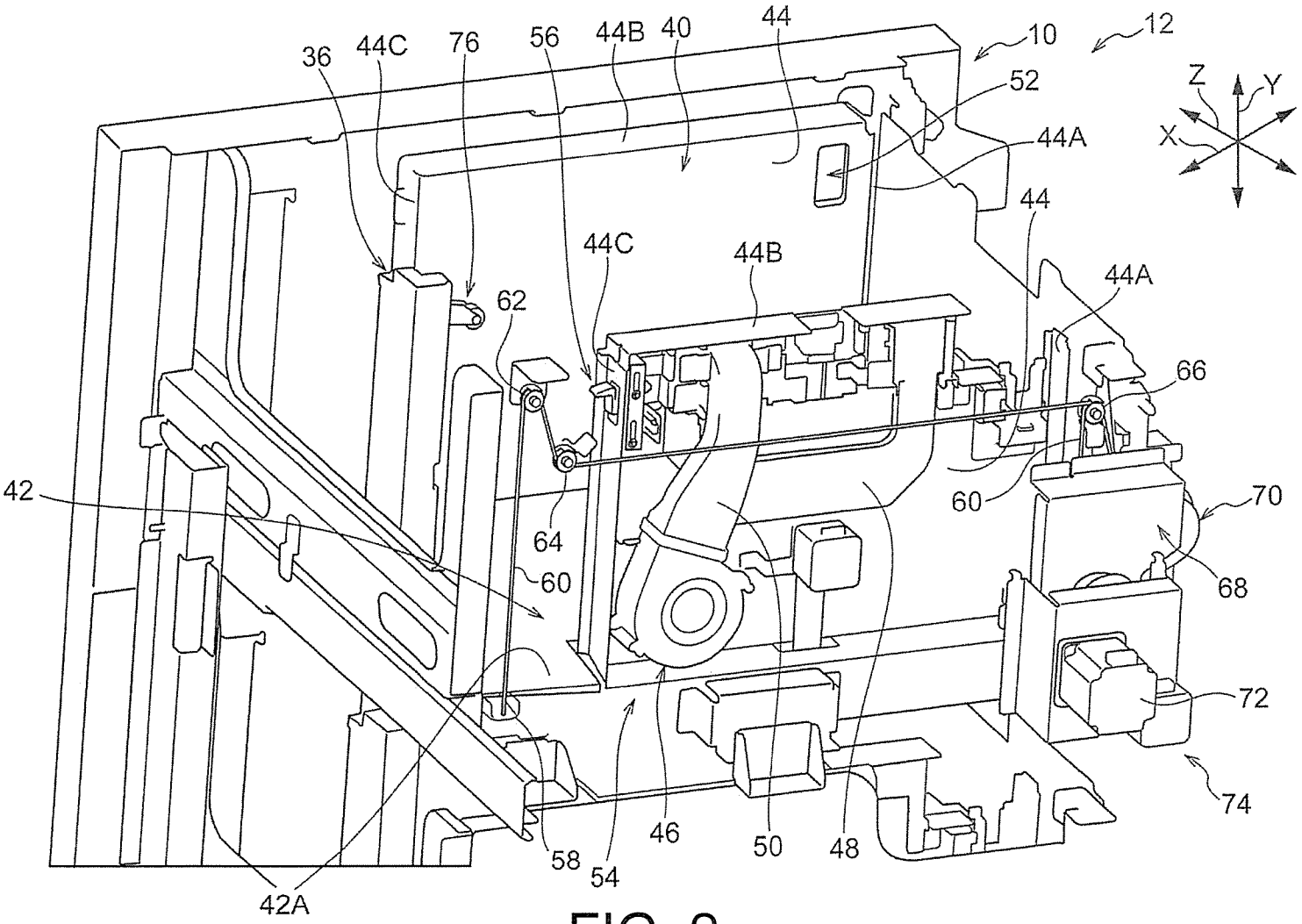
FIG. 2 is a perspective view illustrating an inside of a containing unit according to the first exemplary embodiment.

FIG. 2 illustrates an inside of the sheet feeding device 12 and illustrates a state where the extended unit 22 has been detached from the sheet feeding device 12 and an end bar 36 has been raised upright. A sheet containing unit 40 in which the sheets P are contained is provided in the sheet feeding device 12.

The sheet containing unit 40 has a tray 42 that constitutes a bottom plate and side walls 44 standing on respective sides of the tray 42, and a position of a rear edge of the sheet P placed on the tray 42 is determined by the end bar 36 and positions of side edges of the sheet P are determined by the side walls 44.

Side Walls

Air blowing fans 46 (only one of which is illustrated) are provided on outer surfaces of the respective side walls 44, and a first duct 48 and a second duct 50 extend from each of the air blowing fans 46. The first duct 48 is connected to an air blowing hole 52 (only an air blowing hole 52 provided in one of the side walls 44 is illustrated) that is provided in an upper part of the side wall 44 so as to be close to the image forming apparatus 14, and thus air blown from the air blowing fans 46 is blown toward the sheet P placed on the tray 42 from both sides.

The air blowing hole 52 has a vertically-long rectangular shape, and air blown through the air blowing hole 52 floats up sheets P within a predetermined height range on an upper side among sheets P placed on the tray 42. In this way, the air blowing fans 46, the first ducts 48, and the air blowing holes 52 of the side walls 44 constitute a floating device 54 that floats up sheets P placed on the tray 42.

A front-edge flange 44A that is bent sideways extends from a front edge of each of the side walls 44 that is close to the image forming apparatus 14, and an upper-edge flange 44B that is bent sideways extends from an upper edge of each of the side walls 44. A rear-edge flange 44C that is bent sideways extends from a rear edge of each of the side walls 44, and a small quantity detector 56 that detects that the number of sheets P on the tray 42 has become small on the basis of the height of the tray 42 is provided on the rear-edge flange 44C of one of the side walls 44.

Tray

The tray 42 has a rectangular plate shape, and a support member 58 that extends in the width direction is provided on a lower surface of a front edge part of the tray 42 that is located close to the image forming apparatus 14 and on a lower surface of a rear edge part of the tray 42 that is located away from the image forming apparatus 14 (only one support member 58 is illustrated). An end of each of the support members 58 extends from the tray 42 (only one end is illustrated), and a front end of a wire 60 is fixed to the end.

The wire 60 extending from the support member 58 provided on the rear edge of the tray 42 is wound around a winding pulley 70 of a lifting lowering unit 68 through a first pulley 62, a second pulley 64, and a third pulley 66 provided in a housing (not illustrated). Furthermore, the wire 60 extending from the support member provided on the front edge of the tray 42 is wound around the winding pulley 70 of the lifting lowering unit 68 through the third pulley 66, and the lifting lowering unit 68 is, for example, provided with a height sensor (not illustrated) that detects a height position of the tray 42.

The winding pulley 70 is connected to a rotary shaft of the driving motor 72, for example, with a clutch interposed therebetween so that the connection is cuttable. The winding pulley 70 is rotated by the driving motor 72 to lift or lower the tray 42 suspended by the wires 60. Cutting off the connection between the driving motor 72 and the winding pulley 70 by operating the clutch enables the tray 42 suspended by the wires 60 to move down by its own weight.

In this way, the wires 60 extending from the support members 58 of the tray 42, the pulleys 62, 64, 66, and 70 that support the wires 60, the driving motor 72 that rotates the winding pulley 70, and the clutch between the driving motor 72 and the winding pulley 70 constitute a lifting lowering device that lifts or lowers the tray 42.

The rear edge part of the tray 42 has an extended part 42A extending sideways, and the extended part 42A moves up and down along the rear-edge flanges 44C of the side walls 44 as the tray 42 moves up and down. Furthermore, the extended part 42A turns the small quantity detector 56 on during lifting of the tray 42.

End Bar

The end bar 36 is disposed on a rear edge side of the tray 42, and a sheet height detector 76 is provided on an upper end part of the end bar 36. The sheet height detector 76 detects a height position of a topmost sheet P placed on the tray 42 and detects that the topmost sheet P has become lower than a height position suitable for feeding.

Sheet Transport Device

Figure 3:
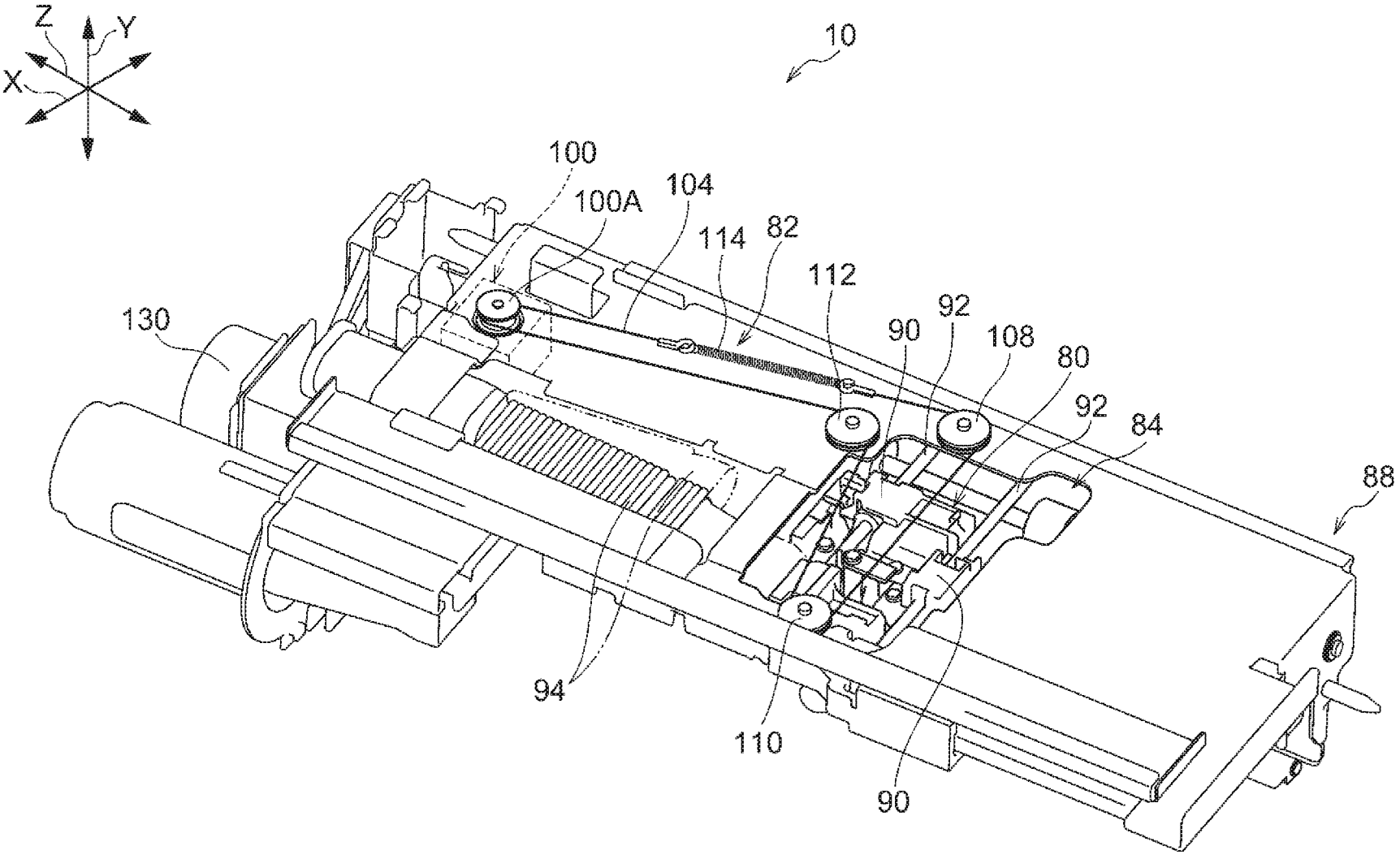
FIG. 3 is a perspective view illustrating the sheet transport device according to the first exemplary embodiment.

As illustrated in FIG. 3, the sheet transport device 10 that transports a sheet P on the tray 42 is provided above the tray 42 so as to be located close to the image forming apparatus 14.

The sheet transport device 10 includes a transport unit 80 that sucks and transports a sheet P floated up by the floating device 54, a negative pressure device (not illustrated) that supplies a negative pressure to the transport unit 80, a moving device 82 that moves the transport unit 80 in the device width direction X, a feeding device 84 that feeds the sheet P transported by the transport unit 80 to the image forming apparatus 14, and a separating device 86 (see FIG. 7) that peels off a sheet P next to a topmost sheet P in a case where plural sheets P are sucked by the transport unit 80. The transport unit 80, the moving device 82, and the feeding device 84 that constitute the sheet transport device 10 are provided as a single unit in a horizontally-long rectangular unit frame 88.

Transport Unit

Figure 4:
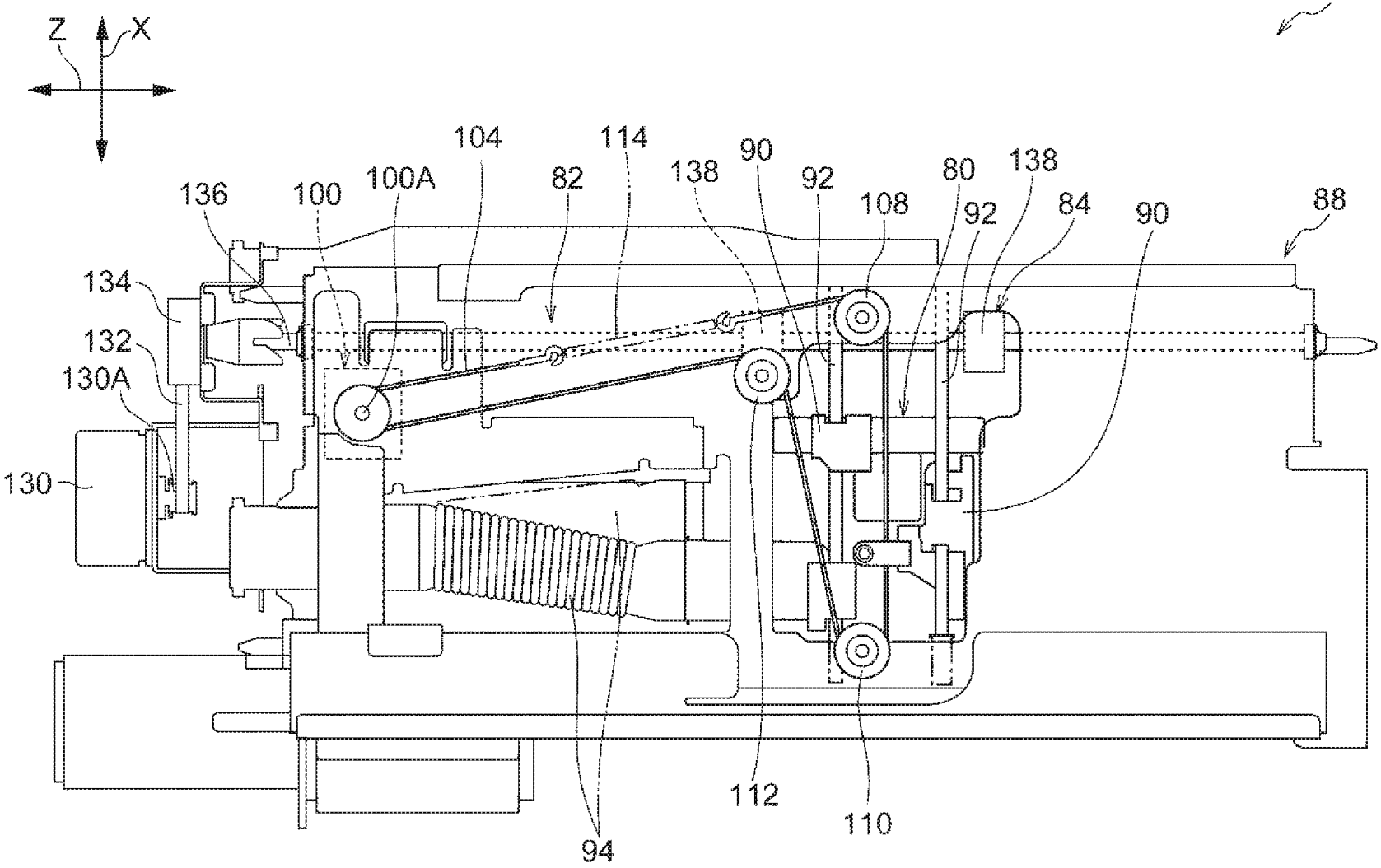
FIG. 4 is a plan view illustrating the sheet transport device according to the first exemplary embodiment.

As illustrated in FIGS. 3 and 4, the transport unit 80 is disposed in a central part in the width direction of the tray 42. The transport unit 80 is provided with a slider 90 on an upper surface thereof and is movably supported by a pair of support shafts 92 suspended in a short-side direction of the unit frame 88 with the slider 90 interposed therebetween.

The transport unit 80 has a negative pressure chamber to which a negative pressure is supplied from the negative pressure device (not illustrated) through a duct 94, and a lower surface of the transport unit 80 has plural suction holes leading to the negative pressure chamber. This allows the transport unit 80 to suck and hold a floated sheet P with a negative pressure from the suction holes.

Note that the transport unit 80 may be an electrostatic suction type transport unit that sucks a sheet P with use of static electricity.

Although the transport unit 80 that transports a sheet P while sucking the sheet P has been described as an example of a transport unit in the present exemplary embodiment, this configuration is not restrictive. For example, the transport unit may be a mechanism that transports a sheet P while holding the sheet P between rolls.

Moving Device

The moving device 82 reciprocates the transport unit 80 between a suction position 96 (see FIG. 9) at which a sheet P on the tray 42 is sucked and a handover position 98 (see FIG. 9) at which a sucked and transported sheet P is handed over to the feeding device 84.

In this way, the transport unit 80 transports a sheet P while sucking the sheet P.

Figure 5:
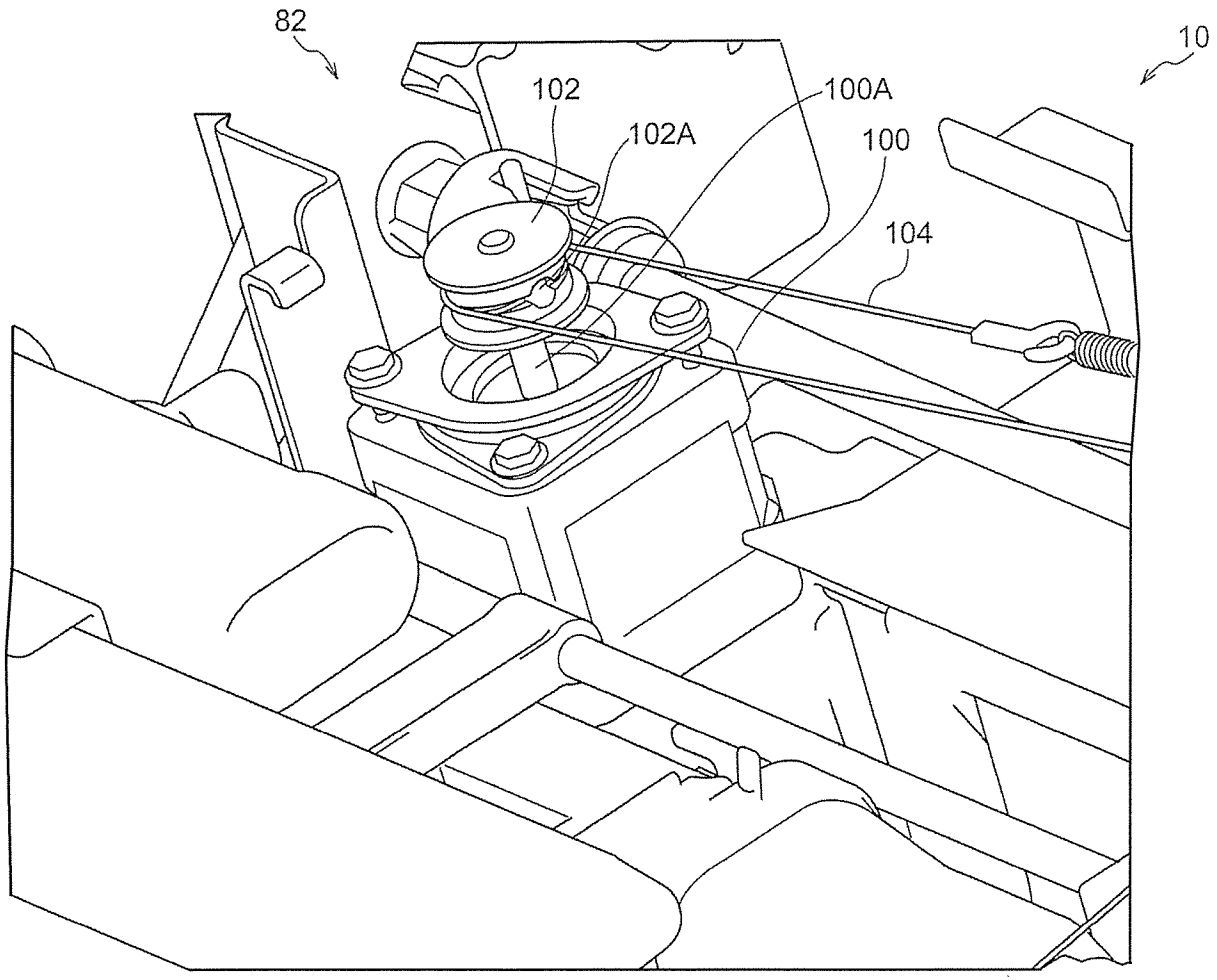
FIG. 5 is a perspective view illustrating a substantial part of FIG. 4.

As illustrated in FIGS. 3 and 4, the moving device 82 includes a moving motor 100 fixed to the unit frame 88. As illustrated in FIG. 5, a driving pulley 102 is provided on a rotary shaft 100A of the moving motor 100. A moving wire 104 is wound around the driving pulley 102, and a ball (not illustrated) crimped to the moving wire 104 is inserted into a hole 102A of the driving pulley 102 to keep the moving wire 104 from sliding.

As illustrated in FIGS. 3 and 4, the moving wire 104 is suspended across a first moving pulley 108, a second moving pulley 110, and a third moving pulley 112 provided in the unit frame 88, and both ends of the moving wire 104 are linked to each other with a coil spring 114 interposed therebetween.

Figure 6:
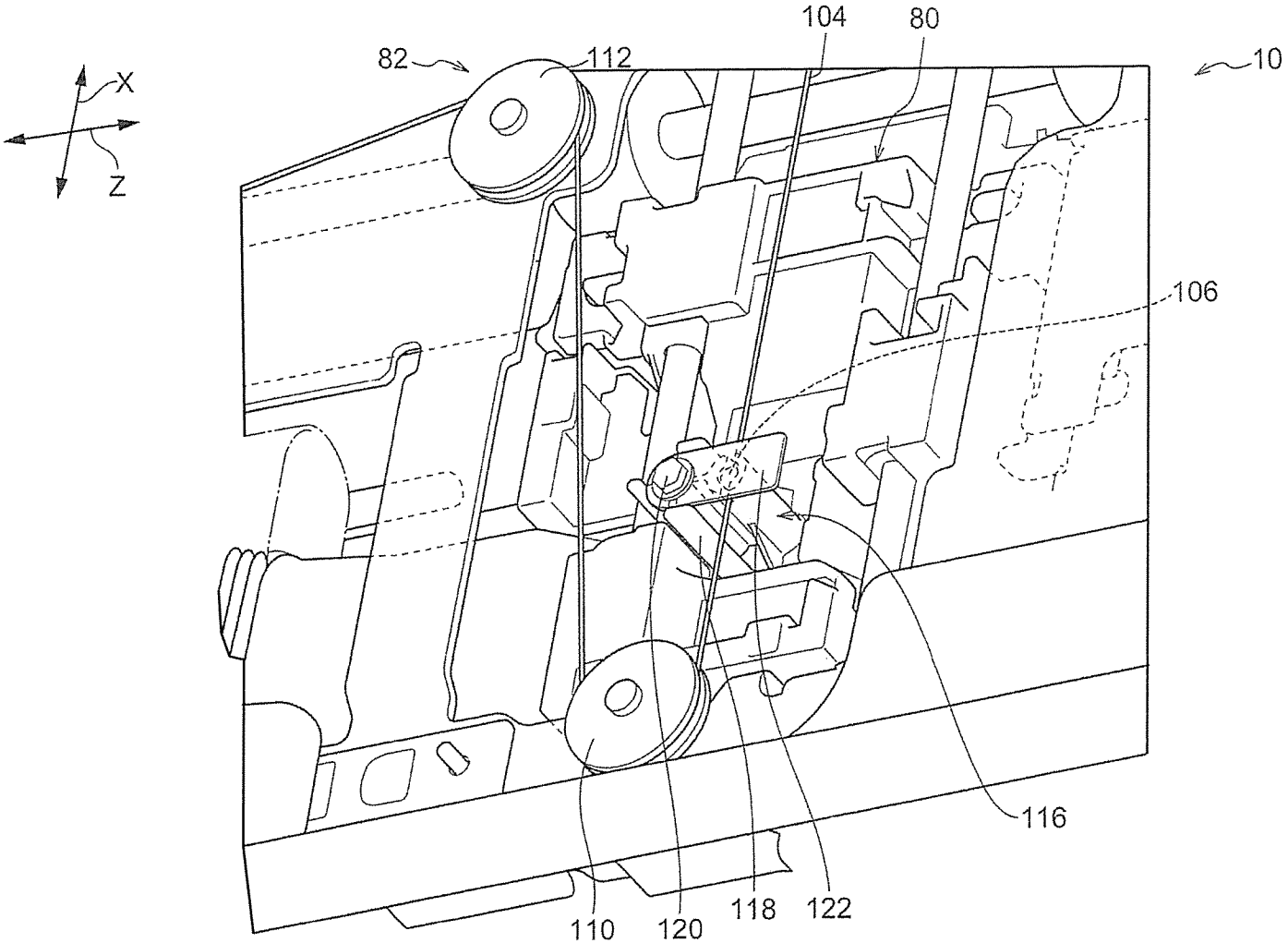
FIG. 6 is a perspective view illustrating another substantial part of FIG. 4.

A part of the moving wire 104 that is located between the first moving pulley 108 and the second moving pulley 110 extends along the support shafts 92. A ball 106 is crimped to a part of the moving wire 104 that is located between the first moving pulley 108 and the second moving pulley 110, as illustrated in FIG. 6.

The ball 106 is contained in a cylindrical part 116 of the transport unit 80, and the transport unit 80 moves as the moving wire 104 to which the ball 106 is fixed moves. An end of the cylindrical part 116 in which the ball 106 is contained is closed by a fixed plate 122 fixed to a support column 118 of the transport unit 80 with use of a bolt 120 so that the ball 106 is kept from being detached.

With this configuration, the moving device 82 reciprocates the transport unit 80 between the suction position 96 and the handover position 98 by circulating the moving wire 104 in forward and reverse directions with the use of the moving motor 100.

Feeding Device

As illustrated in FIG. 4, the feeding device 84 includes a feeding motor 130 that is provided at an end, in a longitudinal direction, of the unit frame 88 and a driven pulley 134 connected to a rotary shaft 130A of the feeding motor 130 with a belt 132 interposed therebetween. Furthermore, the feeding device 84 includes a rotary shaft 136 that is connected to the driven pulley 134 and is rotatably supported by the unit frame 88 and a pair of driving rolls 138 fixed to parts of the rotary shaft 136 that are close to the transport unit 80.

Figure 7:
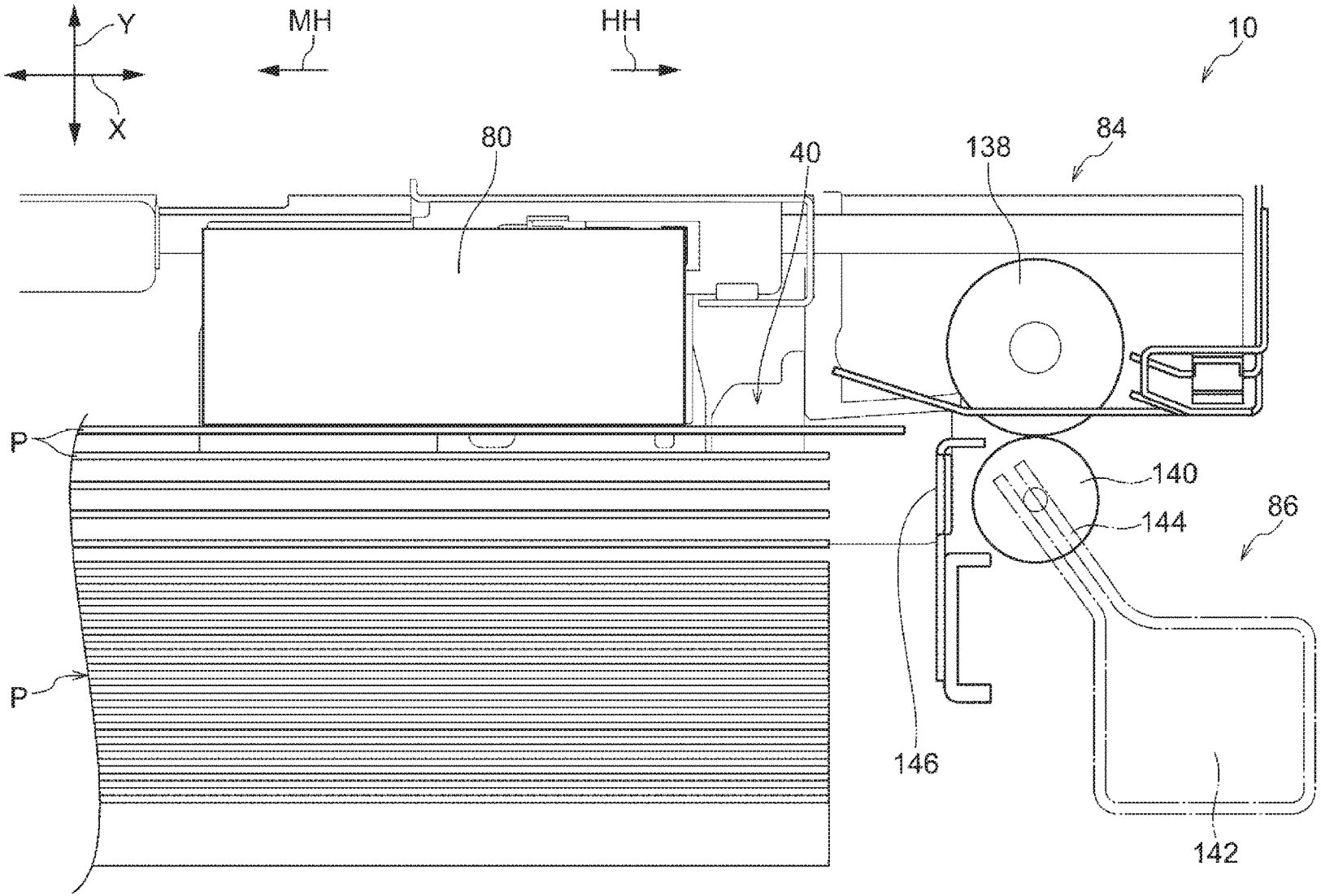
FIG. 7 is a side view illustrating a substantial part of the containing unit according to the first exemplary embodiment.

As illustrated in FIG. 7, the feeding device 84 includes driven rolls 140 that are disposed so as to face the driving rolls 138 and are rotatably supported by a frame (not illustrated). With this configuration, the feeding device 84 receives a sheet P transported by the transport unit 80 and feeds the sheet P to the image forming apparatus 14 by rotating the driven rolls 140 with use of the feeding motor 130 while holding the sheet P between the driving rolls 138 and the driven rolls 140.

Separating Device

Figure 8:
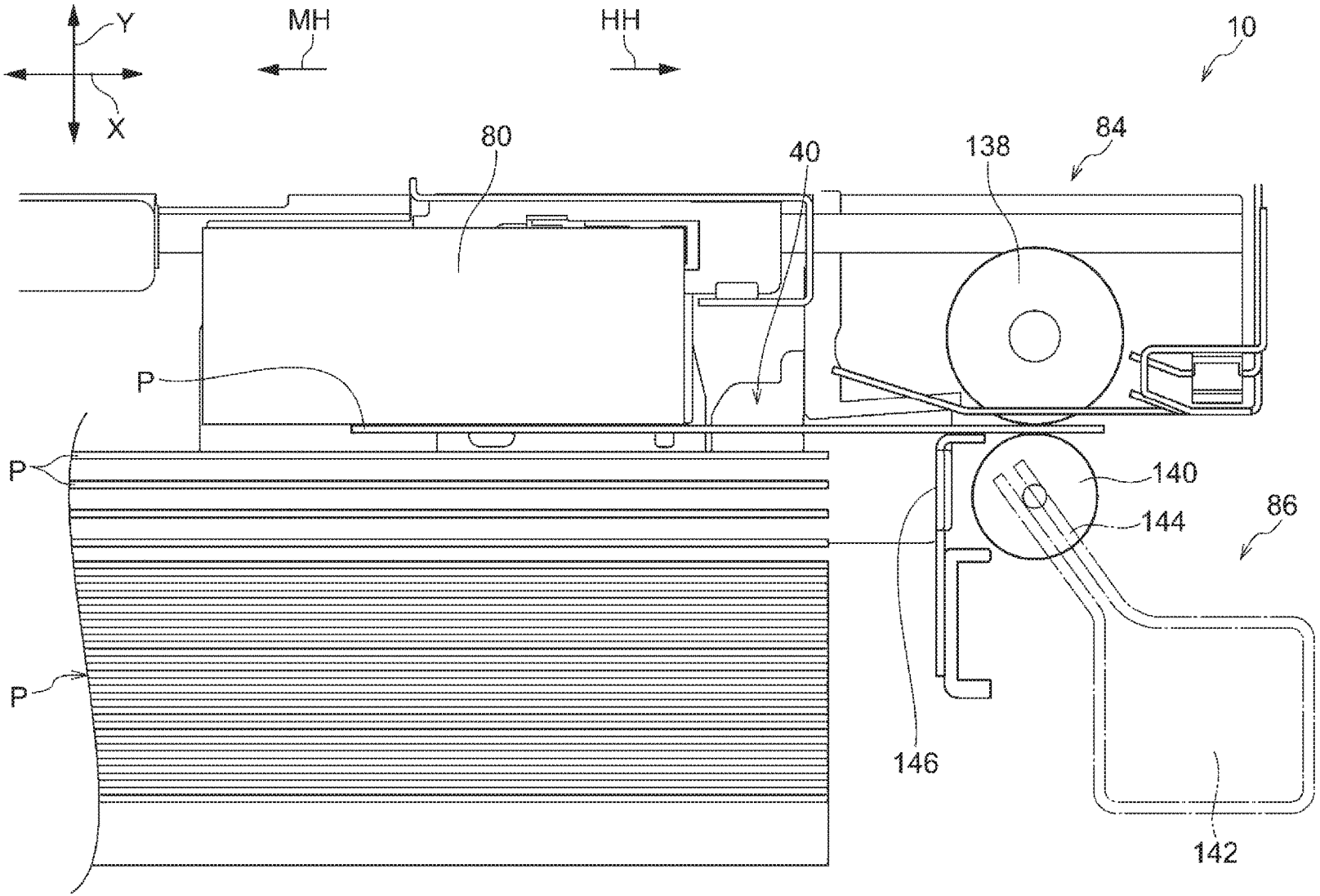
FIG. 8 is an explanatory view illustrating operation continued to FIG. 7.

As illustrated in FIGS. 7 and 8, the separating device 86 is disposed closer to the image forming apparatus 14 than the tray 42, and the separating device 86 includes an air chamber 142 and an air supplying device (not illustrated) that supplies air to the air chamber 142. A hollow nozzle 144 extends from the air chamber 142, and the nozzle 144 is disposed between the pair of driven rolls 140.

The nozzle 144 ejects air toward a lower surface of the sheet P transported by the transport unit 80 diagonally upward from the image forming apparatus 14 side. In this way, the separating device 86 causes sheets P excluding a sheet P on the transport unit 80 side to be separated and fall off by air ejected from the nozzle 144 in a case where plural sheets P are sucked by the transport unit 80.

Furthermore, a separating wall 146 is provided between the air chamber 142 and the sheet containing unit 40. In a case where plural sheets P are sucked by the transport unit 80, the separating wall 146 interferes with sheets P excluding a sheet P on the transport unit 80 side so that these sheets P are separated and fall off.

Figure 9:
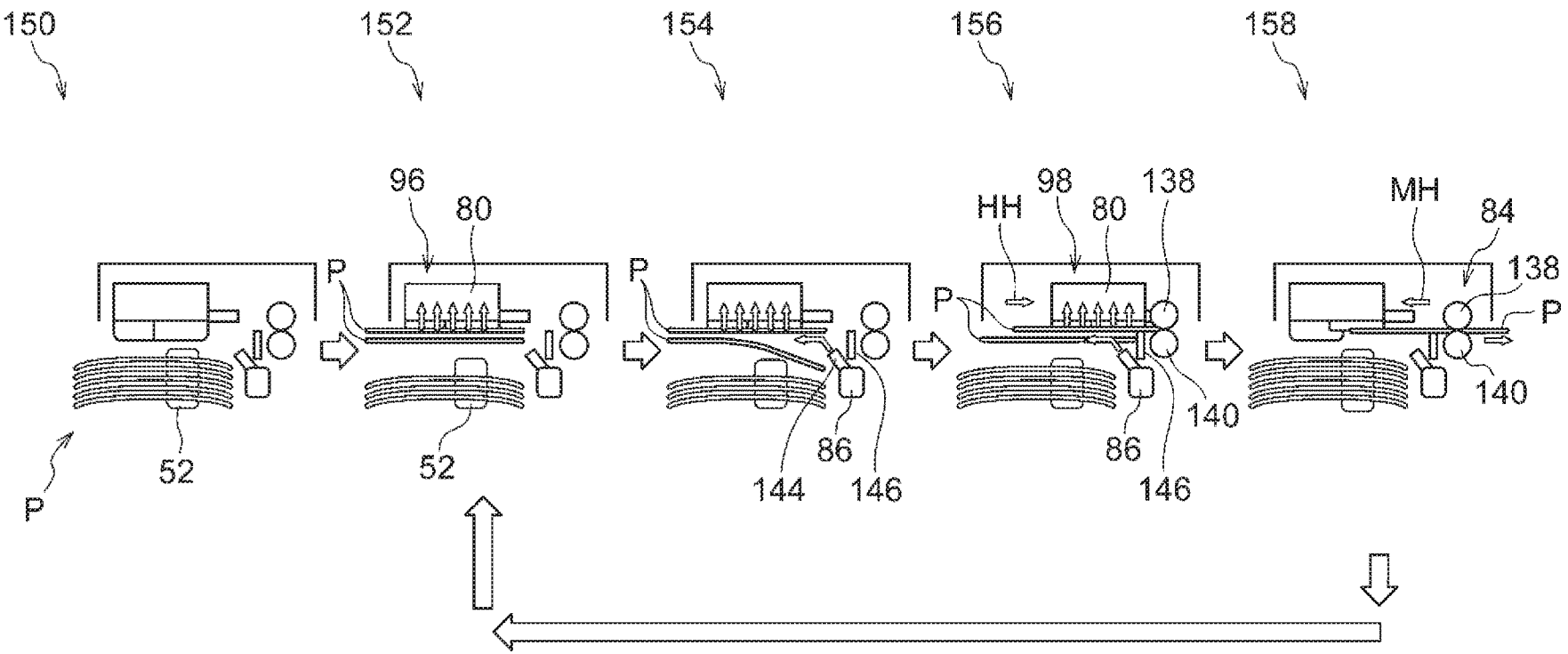
FIG. 9 is an explanatory view illustrating operation of the sheet transport device according to the first exemplary embodiment.

FIG. 9 illustrates operation of the sheet transport device 10. To feed a sheet P from the sheet feeding device 12 to the image forming apparatus 14, upper sheets P on the tray 42 are floated up by air blown from both sides by the floating device 54 (floating step 150).

Then, the floated sheets P are sucked onto the lower surface of the transport unit 80 at the suction position 96 by a negative pressure supplied to the transport unit 80 by the negative pressure device (sucking step 152), and the transport unit 80 is moved to the handover position 98 by the moving device 82.

When the movement of the transport unit 80 starts, air is ejected from the nozzle 144 toward a lower surface of the sheets P transported by the transport unit 80 by the separating device 86 so that sheets P excluding a sheet P on the transport unit 80 side among the sheets P sucked by the transport unit 80 are separated and fall off (separating step 154). In this step, a sheet P that does not fall off from the sheet P on the transport unit 80 side is separated by the separating wall 146 so as to fall onto the tray 42.

Then, the sucked sheet P is held between the driving rolls 138 and the driven rolls 140 of the feeding device 84 that is operating by moving the transport unit 80 to the handover position 98 and is thus handed over (handover step 156), and the sheet P held between the driving rolls 138 and the driven rolls 140 is delivered to the image forming apparatus 14 (delivering step 158).

When the handover of the sheet P to the feeding device 84 is finished, the negative pressure device is stopped to release the sheet P sucked by the transport unit 80, and the moving device 82 is reversed to move the transport unit 80 to the suction position 96.

Hardware Configuration of Sheet Transport Device

Figure 10:
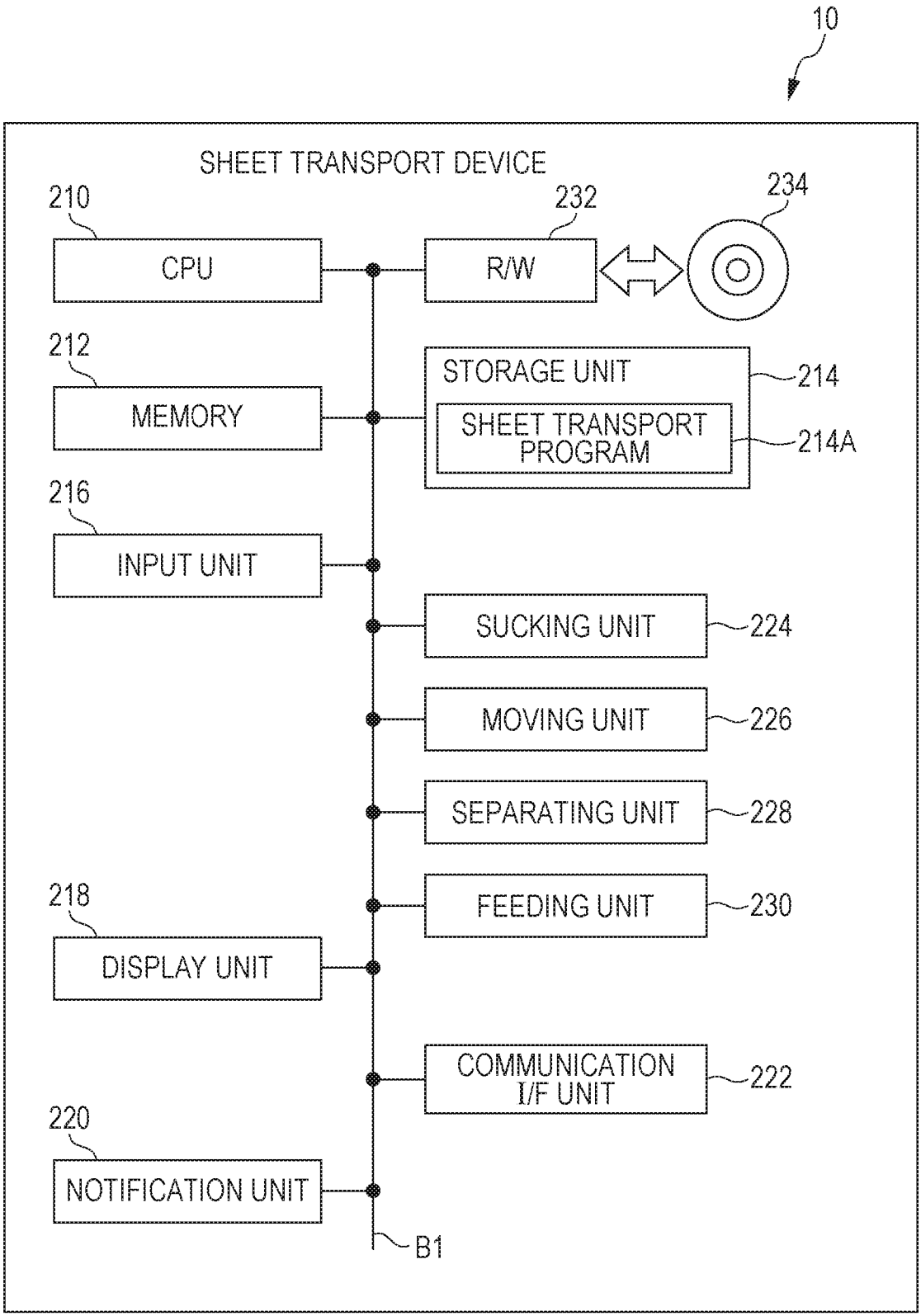
FIG. 10 is a block diagram illustrating an example of a hardware configuration of the sheet transport device according to the exemplary embodiment.

As illustrated in FIG. 10, the sheet transport device 10 includes a central processing unit (CPU) 210, which is a controller and a processor, a memory 212 that serves as a temporary storage region, a non-volatile storage unit 214, an input unit 216, and a display unit 218 such as a liquid crystal display.

Furthermore, the sheet transport device 10 includes a notification unit 220 such as a speaker, a communication interface (I/F) unit 222 for communication with an external device or the like, and a sucking unit 224 that includes the negative pressure device. Furthermore, the sheet transport device 10 includes a moving unit 226 that includes the moving device 82, a separating unit 228 that includes the separating device 86, and a feeding unit 230 that includes the feeding device 84.

The sheet transport device 10 includes a medium reading writing device (R/W) 232 as an example of a device for program input.

The CPU 210, the memory 212, the storage unit 214, the input unit 216, the display unit 218, the notification unit 220, the communication I/F unit 222, the sucking unit 224, the moving unit 226, the separating unit 228, and the feeding unit 230 are connected to one another through a bus B1. The medium reading writing device 232 reads out information from a storage medium 234 and writes information into the storage medium 234.

The input unit 216 is connected to members such as the small quantity sensor 56, the sheet height detector 76, and an operation panel of the sheet transport device 10. The input unit 216 supplies states of the small quantity sensor 56 and the sheet height detector 76 and information entered on the operation panel to the CPU 210.

The operation panel receives information entered by a user such as size information indicative of a size of sheets P contained in the containing units 16 and 18 and basis weight information on a weight of a sheet P per unit area, and these pieces of information are stored in the memory 212.

The basis weight is a weight ($g/m^2$) per unit area of a sheet P, and a thickness dimension of the sheet P can be determined from the basis weight.

The storage unit 214 is, for example, a hard disk drive (HDD), a solid state drive (SSD), or a flash memory. The storage medium 234 serving as a storage unit stores therein a sheet transport program 214A for causing the sheet transport device 10 to operate.

The sheet transport program 214A is read out from the storage medium 234 set in the medium reading writing device 232 and is then stored in the storage unit 214. The sheet transport program 214A may be downloaded over a network.

The CPU 210 reads out the sheet transport program 214A from the storage unit 214, loads the sheet transport program 214A into the memory 212, and sequentially executes processes of the sheet transport program 214A. In this way, the CPU 210 serves as a processor and a controller. The CPU 210 operates in accordance with the sheet transport program 214A, thereby causing the sheet transport device 10 to operate.

Operation

Next, operation of the sheet transport device 10 according to the present exemplary embodiment is described with reference to FIGS. 11 through 16.

Movement Adjusting Processing (1)

Figure 11:
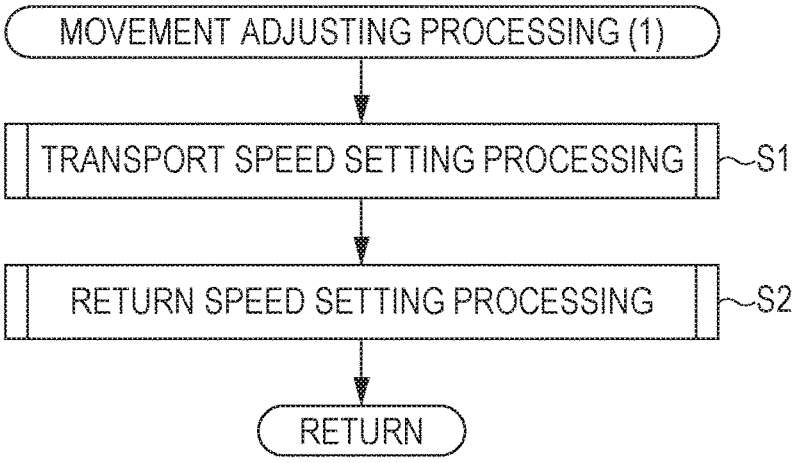
FIG. 11 is a flowchart illustrating an example of movement adjusting processing (1) according to the first exemplary embodiment.

FIG. 11 illustrates movement adjusting processing (1). When the CPU 210 of the sheet transport device 10 executes the sheet transport program 214A and the movement adjusting processing (1) is called up during processing for transporting a sheet, transport speed setting processing is executed (S1), as illustrated in FIG. 11.

Transport Speed Setting Processing

Figure 12:
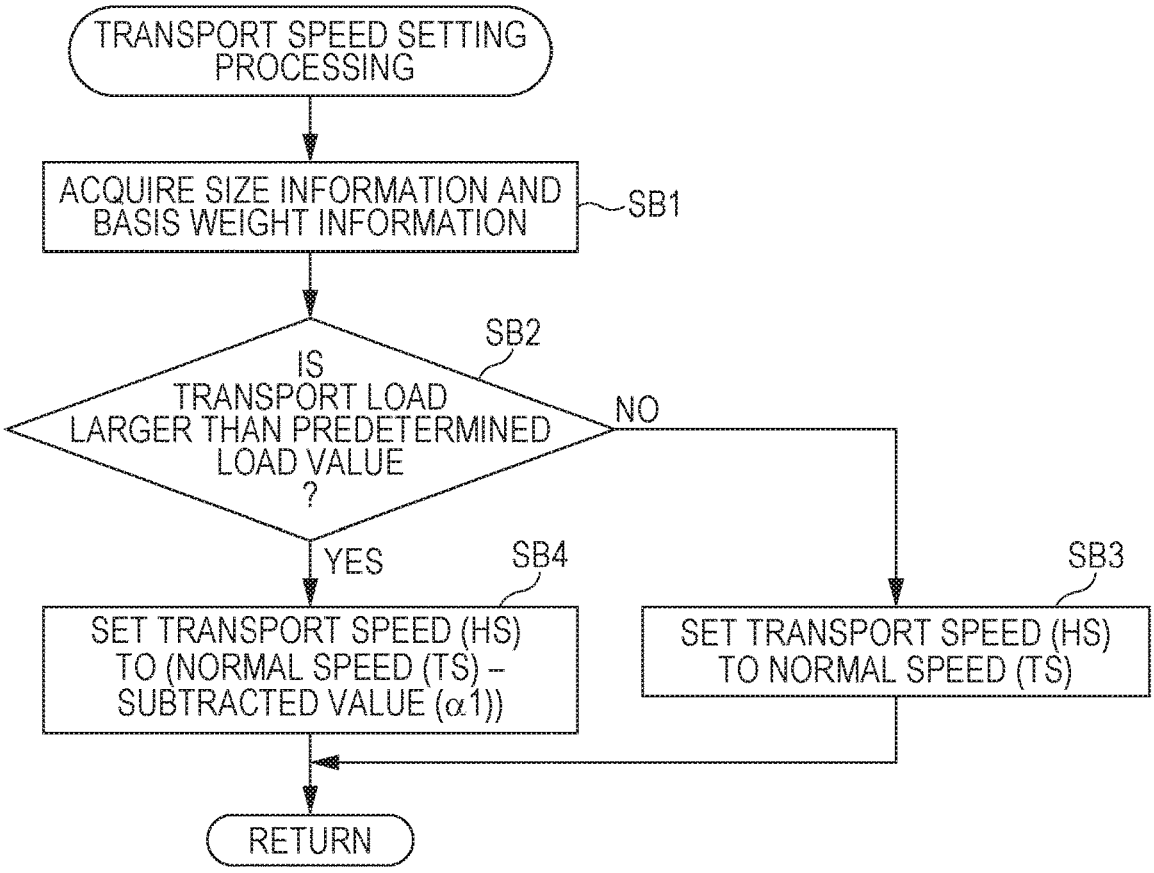
FIG. 12 is a flowchart illustrating an example of transport speed setting processing according to the first exemplary embodiment.

In the transport speed setting processing, a load during transport is found on the basis of the size information and the basis weight information stored in the memory 212 (SB1), and it is determined whether or not the transport load is larger than a predetermined load value stored in the memory 212 (SB2), as illustrated in FIG. 12.

The basis weight information received from the memory 212 indicates a weight per unit area, and the size information indicates a size of the sheets P. Therefore, the weight of a transported sheet P can be found from the basis weight information and the size information. The transport load during transport of a sheet P increases in proportion to the weight of the sheet P, and therefore the transport load of the sheet P can be obtained from the basis weight information and the size information.

In a case where it is determined in step SB2 that the transport load is not larger than the predetermined load value, a value of a transport speed (HS) set in the memory 212 is set to a normal speed (TS) stored in the memory 212 (SB3). Then, the processing returns to the movement adjusting processing (1) that called up the transport speed setting processing, and then return speed setting processing (S2) is executed.

A value of the transport speed (HS) indicates a speed at which the transport unit 80 moves from the suction position 96 to the handover position 98, and the sheet transport device 10 moves the transport unit 80 that has sucked the sheet P to the image forming apparatus 14 at a speed indicated by the value of the transport speed (HS). The normal speed (TS) indicates a speed set as a standard and indicates a moving speed of the transport unit 80 during transport of a sheet P having a standard weight.

Accordingly, in a case where it is determined that the transport load is not larger than the predetermined load value, the value of the transport speed (HS) is set to the normal speed (TS).

In a case where it is determined in step SB2 that the transport load is larger than the predetermined load value, the value of the transport speed (HS) set in the memory 212 is set to a value obtained by subtracting a value ($\alpha$1) stored in the memory 212 from the normal speed (TS) stored in the memory 212 (SB4). Then, the processing returns to the movement adjusting processing (1) that called up the transport speed setting processing, and then the return speed setting processing (S2) is executed.

That is, in a case where the transport load is larger than the predetermined load value, the value of the transport speed (HS) is set to (the normal speed (TS)—the subtracted value ($\alpha$1)), which is lower than the normal speed (TS).

In this way, the movement of the transport unit 80 that transports the sheet P is adjusted on the basis of the transport load of the transported sheet P.

Examples of the movement of the transport unit 80 include a speed and an acceleration of the transport unit 80. In the present exemplary embodiment, the speed of the transport unit 80 is adjusted as the movement of the transport unit 80.

Specifically, in a case where the transport load is larger than the predetermined load value, the movement is adjusted by making a transport speed at which the transport unit 80 is moved in a transport direction lower than the transport speed set in a case where the transport load is equal to or lower than the predetermined load value.

Return Speed Setting Processing

Figure 13:
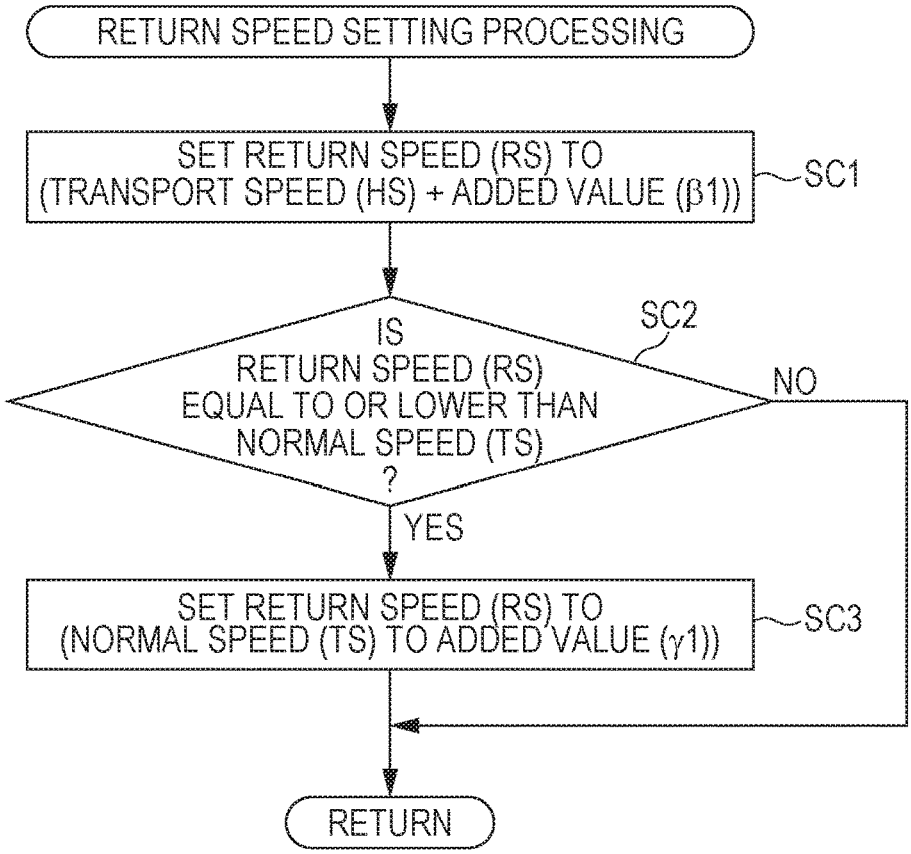
FIG. 13 is a flowchart illustrating an example of return speed setting processing according to the first exemplary embodiment.

In the return speed setting processing, a value of a return speed (RS) set in the memory 212 is set to a value obtained by adding a value ($\beta$1) stored in the memory 212 to a value set as the transport speed (HS) (SC1), as illustrated in FIG. 13.

The return speed (RS) indicates a speed at which the transport unit 80 is returned from the handover position 98 to the suction position 96, and the sheet transport device 10 makes the return speed (RS) at which the transport unit 80 is returned in a direction reverse to the transport direction higher by the added value (β1) than the transport speed (HS) at which the transport unit 80 is moved in the transport direction.

Then, it is determined whether or not the value of the return speed (RS) is equal to or lower than the normal speed (TS) stored in the memory 212 (SC2). In a case where it is determined in step SC2 that the value of the return speed (RS) is higher than the normal speed (TS) stored in the memory 212, the processing returns to the movement adjusting processing (1) that called up the return speed setting processing.

Meanwhile, in a case where it is determined in step SC2 that the value of the return speed (RS) is equal to or lower than the normal speed (TS) stored in the memory 212, the value of the return speed (RS) is set to a value obtained by adding a value (y1) stored in the memory 212 to the normal speed (TS) stored in the memory 212 (SC3), and the processing returns to the movement adjusting processing (1) that called up the return speed setting processing.

In this way, the return speed (RS) is made higher than the transport speed (HS) set in a case where the transport load is equal to or lower than the predetermined load value.

In the movement adjusting processing (1), the processing returns to the routine that called up the movement adjusting processing (1) to continue the processing for transporting the sheet P, and a moving speed of the transport unit 80 is controlled to a value set as the transport speed (HS) while the transport unit 80 is moved from the suction position 96 to the handover position 98. Furthermore, the moving speed of the transport unit 80 is controlled to a value set as the return speed (RS) while the transport unit 80 is moved from the handover position 98 to the suction position 96.

Effects

Effects of the present exemplary embodiment related to the above configuration are described below.

In the present exemplary embodiment, movement of the transport unit 80 that transports a sheet P is adjusted on the basis of a transport load of the transported sheet P.

This can make a transport failure less likely to occur with a low-cost structure as compared with a case where the transport speed of the sheet P is always constant.

Specifically, it is necessary to increase force for sucking a sheet P by the transport unit 80 against an acceleration load in order to achieve high-speed transport while holding a heavy sheet P such as thick paper by suction. In this case, an increase in size and cost of the negative pressure device that supplies a negative pressure to the transport unit 80 cannot be avoided.

Meanwhile, in the present exemplary embodiment, a transport failure such as a suction failure and fall-off of a sheet P during transport can be made less likely to occur while avoiding an increase in size and cost of the negative pressure device by adjusting movement of the transport unit 80 that transports the sheet P on the basis of a transport load of the transported sheet P.

Furthermore, the transport load is obtained from size information indicative of a size of the sheet P and basis weight information indicative of a weight of the sheet per unit area.

This can achieve an improvement in operability as compared with a case where weight information of the sheet P needs to be entered in addition to the size information and the basis weight information.

Furthermore, the transport unit 80 transports the sheet P while sucking the sheet P.

This can omit a mechanism for rotating rolls as compared with a case where the sheet P is transported by rolls. Furthermore, influence of paper powder becomes smaller during paper transport.

In addition, in a case where the transport load is larger than a predetermined load value, the movement is adjusted by making a transport speed (HS) at which the transport unit 80 is moved in a transport direction (HH) lower than the transport speed (HS) set in a case where the transport load is equal to or smaller than the predetermined load value.

It is therefore possible to shorten a period it takes for the transport unit 80 to reach a specified speed as compared with a case where the movement is adjusted by lowering an acceleration.

Furthermore, the return speed (RS) at which the transport unit 80 is returned in a direction reverse to the transport direction (HH) is made higher than the transport speed (HS) at which the transport unit 80 is moved in the transport direction (HH).

This can shorten a period required for a transport cycle as compared with a case where the transport speed and the return speed are the same.

Furthermore, the return speed (RS) is made higher than the transport speed (HS) set in a case where the transport load is equal to or smaller than the predetermined load value.

This can further shorten a period required for a transport cycle as compared with a case where the transport speed and the return speed are the same.

Although all of the processing steps in FIG. 11 are executed in the present exemplary embodiment, this configuration is not restrictive, and some of the processing steps may be executed.

Second Exemplary Embodiment

Figure 14:
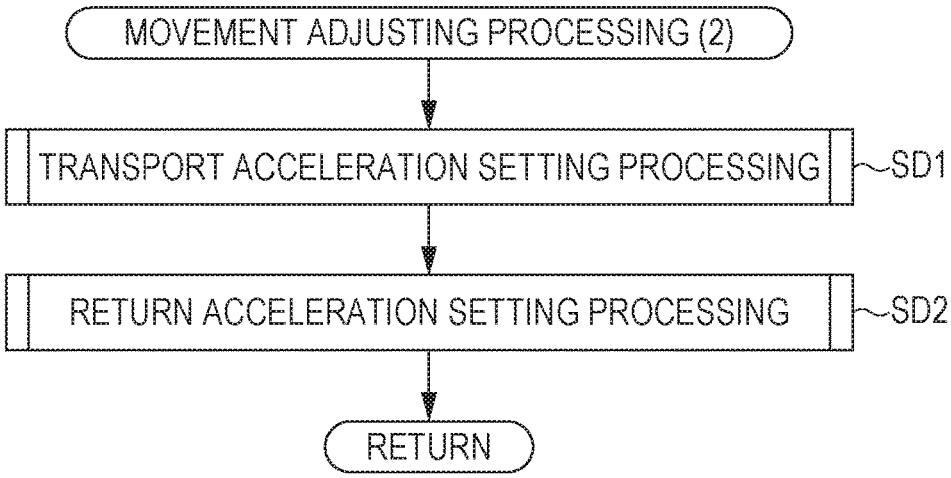
FIG. 14 is a flowchart illustrating an example of movement adjusting processing (2) according to a second exemplary embodiment.
Figure 15:
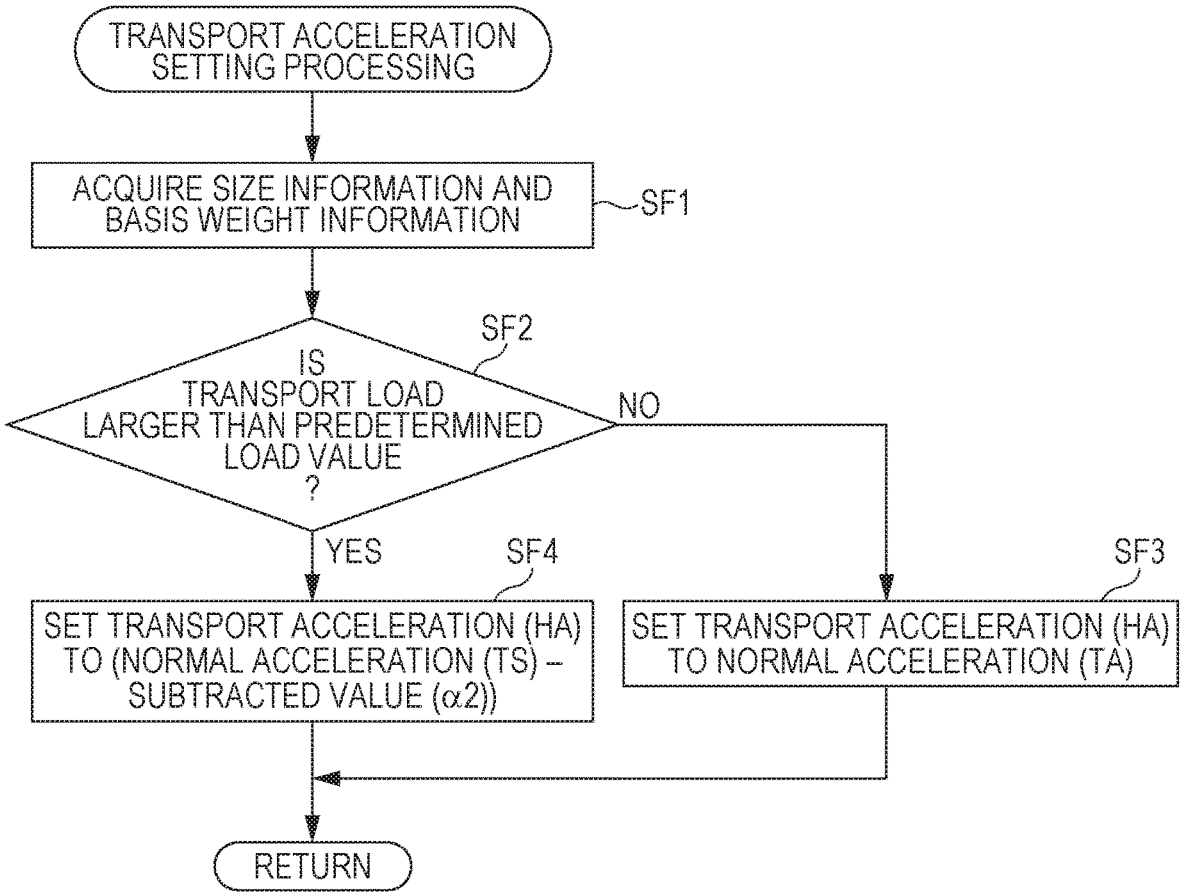
FIG. 15 is a flowchart illustrating an example of transport acceleration setting processing according to the second exemplary embodiment.
Figure 16:
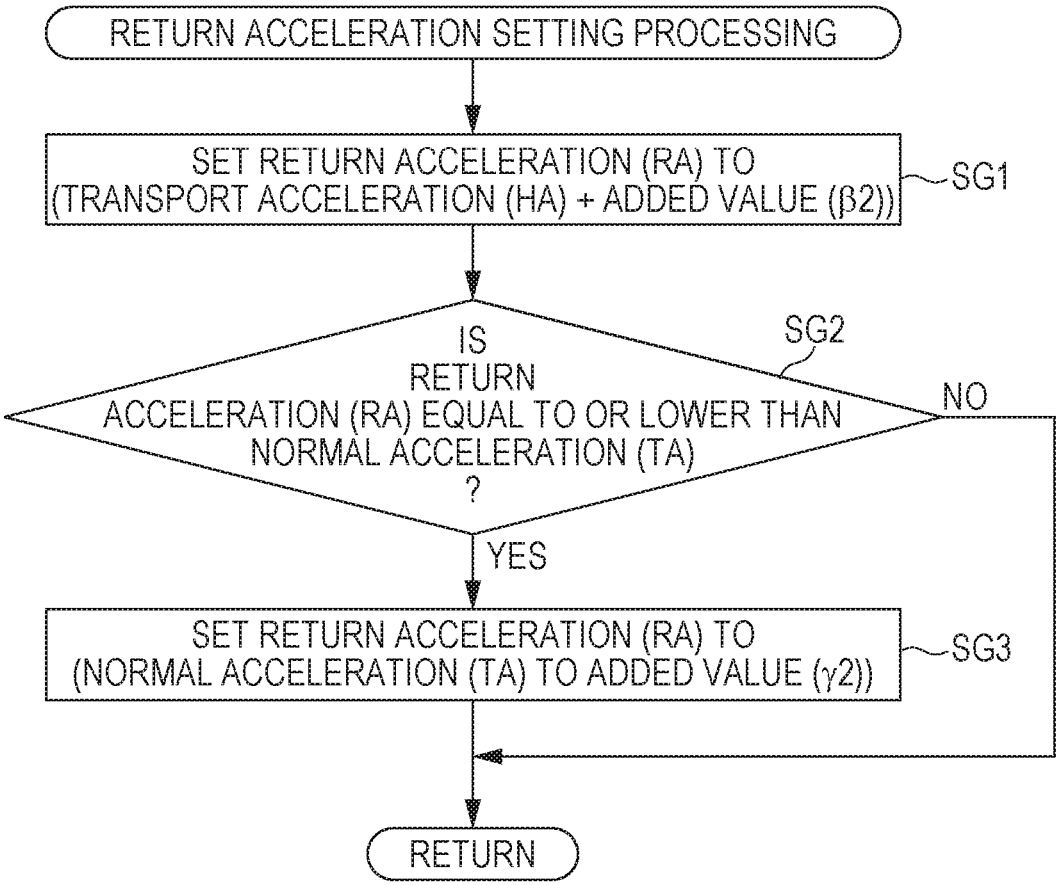
FIG. 16 is a flowchart illustrating an example of return acceleration setting processing according to the second exemplary embodiment.

FIGS. 14 through 16 are flowcharts illustrating operation of a sheet transport device 10 according to a second exemplary embodiment. A hardware configuration in the second exemplary embodiment is identical to the hardware configuration in the first exemplary embodiment, and only differences are described below.

Movement Adjusting Processing (2)

When a CPU 210 of the sheet transport device 10 executes a sheet transport program 214A and movement adjusting processing (2) is called up during processing for transporting a sheet P, transport acceleration setting processing is executed (SD1), as illustrated in FIG. 14.

Transport Acceleration Setting Processing

In the transport acceleration setting processing, a load during transport is found on the basis of size information and basis weight information stored in a memory 212 (SF1), and it is determined whether or not the transport load is larger than a predetermined load value stored in the memory 212 (SF2), as illustrated in FIG. 15.

In a case where it is determined in step SF2 that the transport load is not larger than the predetermined load value, a value of a transport acceleration (HA) set in the memory 212 is set to a normal acceleration (TA) stored in the memory 212 (SF3). Then, the processing returns to the movement adjusting processing (2) that called up the transport acceleration setting processing, and then return acceleration setting processing (SD2) is executed.

A value of the transport acceleration (HA) indicates an acceleration at which a transport unit 80 that moves from a suction position 96 to a handover position 98 is accelerated, and the sheet transport device 10 causes the transport unit 80 that has sucked the sheet P and moves to the image forming apparatus 14 to be accelerated at an acceleration indicated by the value of the transport acceleration (HA). A normal acceleration (TA) indicates an acceleration set as a standard and indicates an acceleration at which the transport unit 80 that transports a sheet P having a standard weight is accelerated.

Accordingly, in a case where it is determined that the transport load is not larger than the predetermined load value, the value of the transport acceleration (HA) is set to the normal acceleration (TA).

In a case where it is determined in step SF2 that the transport load is larger than the predetermined load value, the value of the transport acceleration (HA) set in the memory 212 is set to a value obtained by subtracting a value (a2) stored in the memory 212 from the normal acceleration (TA) stored in the memory 212 (SF4). Then, the processing returns to the movement adjusting processing (2) that called up the transport acceleration setting processing, and then the return acceleration setting processing (SD2) is executed.

Accordingly, in a case where the transport load is larger than the predetermined load value, the value of the transport acceleration (HA) is set to (the normal acceleration (TA)—the subtracted value (a2)), which is lower than the normal acceleration (TA).

In this way, movement of the transport unit 80 that transports a sheet P is adjusted on the basis of a transport load of the transported sheet P.

Examples of the movement of the transport unit 80 include a speed and an acceleration of the transport unit 80. In the present exemplary embodiment, the acceleration of the transport unit 80 is adjusted as the movement of the transport unit 80.

Specifically, in a case where the transport load is larger than the predetermined load value, the movement is adjusted by making the transport acceleration (HA) at which the transport unit 80 moves in a transport direction (HH) lower than the transport acceleration (HA) set in a case where the transport load is equal to or lower than the predetermined load value.

Return Acceleration Setting Processing

In the return acceleration setting processing, a value of a return acceleration (RA) set in the memory 212 is set to a value obtained by adding a value (β2) stored in the memory 212 to a value set as the transport acceleration (HA) (SG1), as illustrated in FIG. 16.

The return acceleration (RA) indicates an acceleration at which the transport unit 80 is returned from the handover position 98 to the suction position 96, and the return acceleration (RA) at which the transport unit 80 is returned in a direction reverse to the transport direction (HH) is made larger by the added value (β2) than the transport acceleration (HA) at which the transport unit 80 is moved in the transport direction (HH).

Then, it is determined whether or not the value of the return acceleration (RA) is equal to or lower than the normal acceleration (TA) stored in the memory 212 (SG2). In a case where it is determined in step SG2 that the value of the return acceleration (RA) is higher than the normal acceleration (TA) stored in the memory 212, the processing returns to the movement adjusting processing (2) that called up the return acceleration setting processing.

Meanwhile, in a case where it is determined in step SG2 that the value of the return acceleration (RA) is equal to or lower than the normal acceleration (TA) stored in the memory 212, the value of the return acceleration (RA) is set to a value obtained by adding a value (y2) stored in the memory 212 to the normal acceleration (TA) stored in the memory 212 (SG3), and the processing returns to the movement adjusting processing (2) that called up the return acceleration setting processing.

In this way, the return acceleration (RA) is made higher than the transport acceleration (HA) set in a case where the transport load is equal to or lower than the predetermined load value.

In the movement adjusting processing (2), the processing returns to the routine that called up the movement adjusting processing (2) to continue the processing for transporting the sheet P, and an acceleration of the transport unit 80 is controlled to a value set as the transport acceleration (HA) while the transport unit 80 is moved from the suction position 96 to the handover position 98. Furthermore, the moving acceleration of the transport unit 80 is controlled to a value set as the return acceleration (RA) while the transport unit 80 is moved from the handover position 98 to the suction position 96.

Effects

Also in the present exemplary embodiment related to the above configuration, parts equivalent with the first exemplary embodiment can produce similar effects.

Furthermore, in the present exemplary embodiment, in a case where the transport load is larger than the predetermined load value, movement of the transport unit 80 is adjusted by making the transport acceleration (HA) at which the transport unit 80 is moved in the transport direction (HH) lower than the transport acceleration (HA) set in a case where the transport load is equal to or smaller than the predetermined load value.

This makes it easy to take measures against a suction failure that can occur during acceleration as compared with a case where movement of the transport unit 80 is adjusted by lowering the transport speed (HS).

Furthermore, the return acceleration (RA) at which the transport unit 80 is returned in a direction reverse to the transport direction (HH) is made higher than the transport acceleration (HA) at which the transport unit 80 is moved in the transport direction (HH).

This makes it possible to shorten a period required for a transport cycle as compared with a case where the transport acceleration and the return acceleration are the same.

Furthermore, the return acceleration is made higher than the transport acceleration (HA) set in a case where the transport load is equal to or smaller than the predetermined value.

This makes it possible to further shorten a period required for a transport cycle as compared with a case where the transport acceleration and the return acceleration are the same.

In the embodiments above, the term "processor" refers to hardware in a broad sense. Examples of the processor includes general processors (e.g., CPU: Central Processing Unit), dedicated processors (e.g., GPU: Graphics Processing Unit, ASIC: Application Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

Although all of the processing steps in FIG. 14 are executed in the present exemplary embodiment, this configuration is not restrictive, and some of the processing steps may be executed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet transport device comprising a processor configured to adjust movement of a transport unit that transports a sheet on a basis of a transport load of the sheet, wherein the transport unit transports the sheet while sucking the sheet, wherein in a case where the transport load is larger than a predetermined value, the processor adjusts the movement by making a transport speed at which the transport unit is moved in a transport direction lower than the transport speed set in a case where the transport load is equal to or smaller than the redetermined value.

2. The sheet transport device according to claim 1, wherein in a case where the transport load is larger than the predetermined value, the processor adjusts the movement by making a transport acceleration at which the transport unit is moved in the transport direction lower than the transport acceleration set in a case where the transport load is equal to or smaller than the predetermined value.

3. The sheet transport device according to claim 2, wherein the processor makes a return acceleration at which the transport unit is returned in a direction reverse to the transport direction higher than the transport acceleration at which the transport unit is moved in the transport direction.

4. The sheet transport device according to claim 3, wherein the processor makes the return acceleration higher than the transport acceleration set in a case where the transport load is equal to or smaller than the predetermined value.

5. The sheet transport device according to claim 1, wherein the processor makes a return speed at which the transport unit is returned in a direction reverse to the transport direction higher than the transport speed at which the transport unit is moved in the transport direction.

6. The sheet transport device according to claim 5, wherein the processor makes the return speed higher than the transport speed set in a case where the transport load is equal to or smaller than the predetermined value.

7. The sheet transport device according to claim 1, wherein the processor obtains the transport load from size information indicative of a size of the sheet and basis weight information indicative of a weight of the sheet per unit area.

8. A sheet transport device comprising a processor configured to adjust movement of a transport unit that transports a sheet on a basis of a transport load of the sheet, wherein the processor obtains the transport load from size information indicative of a size of the sheet and basis weight information indicative of a weight of the sheet per unit area, wherein in a case where the transport load is larger than a predetermined value, the processor adjusts the movement by making a transport speed at which the transport unit is moved in a transport direction lower than the transport speed set in a case where the transport load is equal to or smaller than the predetermined value.

9. The sheet transport device according to claim 8, wherein the transport unit transports the sheet while sucking the sheet.

10. The sheet transport device according to claim 9, wherein in a case where the transport load is larger than the predetermined value, the processor adjusts the movement by making a transport acceleration at which the transport unit is moved in the transport direction lower than the transport acceleration set in a case where the transport load is equal to or smaller than the predetermined value.

11. The sheet transport device according to claim 10, wherein the processor makes a return acceleration at which the transport unit is returned in a direction reverse to the transport direction higher than the transport acceleration at which the transport unit is moved in the transport direction.

12. The sheet transport device according to claim 11, wherein the processor makes the return acceleration higher than the transport acceleration set in a case where the transport load is equal to or smaller than the predetermined value.

13. The sheet transport device according to claim 8, wherein the processor makes a return speed at which the transport unit is returned in a direction reverse to the transport direction higher than the transport speed at which the transport unit is moved in the transport direction.

14. The sheet transport device according to claim 13, wherein the processor makes the return speed higher than the transport speed set in a case where the transport load is equal to or smaller than the predetermined value.

* * * * *